United States Patent [19]

Sefton

[11] Patent Number: 4,729,446

[45] Date of Patent: Mar. 8, 1988

[54] MOBILE SPHERE

[76] Inventor: John S. Sefton, 280 Angust Crescent, Regina, Saskatchewan, Canada, S4T 6N4

[21] Appl. No.: 923,406

[22] Filed: Oct. 27, 1986

[30] Foreign Application Priority Data

Oct. 31, 1985 [CA] Canada ..... 494298

[51] Int. Cl.[4] ..... A63G 29/00

[52] U.S. Cl. ..... 180/21; 280/206; 446/431

[58] Field of Search ..... 280/206, 207, 208; 180/21; 272/115; 152/1, 5, 11, 13, 14, 17, 69, 75; 446/431, 465, 448

[56] References Cited

U.S. PATENT DOCUMENTS

| | | | |
|---|---|---|---|
| 837,784 | 12/1906 | Bossuet | 244/14 |
| 916,456 | 3/1909 | Laisy | 244/14 |
| 939,483 | 11/1909 | Dysart | 244/14 |
| 1,189,138 | 6/1916 | Laisy | 244/14 |
| 1,626,183 | 4/1927 | Candray | 244/14 |
| 1,840,541 | 1/1932 | Stone | 244/14 |
| 2,013,250 | 9/1935 | Phillips | 244/14 |
| 3,156,486 | 11/1964 | Fenwick | 280/206 |
| 3,183,544 | 5/1965 | Bailey | 152/5 X |
| 3,327,801 | 6/1967 | Ezra | 280/206 X |
| 3,334,915 | 8/1967 | Sulyma et al. | 280/206 |
| 3,747,956 | 7/1973 | Heberlein | 280/206 |
| 4,501,569 | 2/1985 | Clark et al. | 280/206 |
| 4,579,336 | 4/1986 | Morin | 280/204 X |

*Primary Examiner*—John A. Pekar

*Attorney, Agent, or Firm*—Ciotti & Murashige, Irell & Manella

[57] ABSTRACT

A hollow sphere formed from a plurality of contra-spiralling members extending through 360° from one end of an axis to the other to form a geodesic frame. Latitudinally extending spaced and parallel reinforcing members may be used to brace the frame. An axle may extend along the axis and may include an elastic motor for the embodiment when used as a toy, a pedal and gear assembly when used as a recreational device and a source of a power when used as a mobile powered device.

20 Claims, 9 Drawing Figures

MOBILE SPHERE

BACKGROUND OF THE INVENTION

This invention relates to new and useful improvements in mobile spheres which may be used as toys, as recreational vehicles, or as transportation vehicles.

Recreational devices are known which take the form of cylinders having loops secured to the inner periphery thereof so that they can be manipulated by an operator transferring his weight from one loop to the other thus causing the cylinder to move along the ground. The cylinder is relatively short in length so that turns can be obtained by moving the weight of the operator to one side or the other of the vertical plane of the device. However these devices are not enclosed at the sides thereof and can cause serious injury if the operator loses control. Furthermore, although they can be turned in one direction or the other, they cannot be caused to roll more than a few degrees from one side or the other of the line of travel.

The present device not only overcomes disadvantages inherent with such recreational devices but also produces a device which can be used as a toy, a recreational device or a transportation device.

The device primarily consists of two sets of resilient members which spiral from one end of an axis to the other and in opposite directions and are secured at the intersections thereof to form an open geodesic type framework, it being understood that the term "geodesic" used in this context and in this specification and claims, refers to the aeronautical construction in which the fuselage and/or wings of an aircraft are formed from contra-spiralling members secured together at the intersections thereof.

SUMMARY OF THE INVENTION

One aspect of the invention is to provide a hollow sphere for use as a toy, a recreational device or as a transportation vehicle comprising in combination one set of resilient members extending from one end of an axis to the other and spiralling through 360° and another set of resilient members extending from said other end of said axis to said one end thereof and spiralling through 360° in the opposite direction of said one set, each set including a plurality of resilient members secured by one end thereof to a hub at said one end of said axis and by the other ends thereof to a hub at said other end of said axis, the members of said one set being secured to the members of the other set where said members intersect thus forming a geodesic configuration.

Another advantage of the invention is that it can be used as a toy by the addition of an elastic motor, as a recreational vehicle with or without a pedal assembly or as a transportational device when used with a source of power such as a gasoline engine.

In all cases where a source of power is provided, it is of course necessary to mount the source of power or provide a weight below the center of gravity of the device to act as a reaction device so that the sphere will rotate whereas the source of power remains substantially in a vertical plane hanging below a transverse axis to which the power is transmitted.

A further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 3:
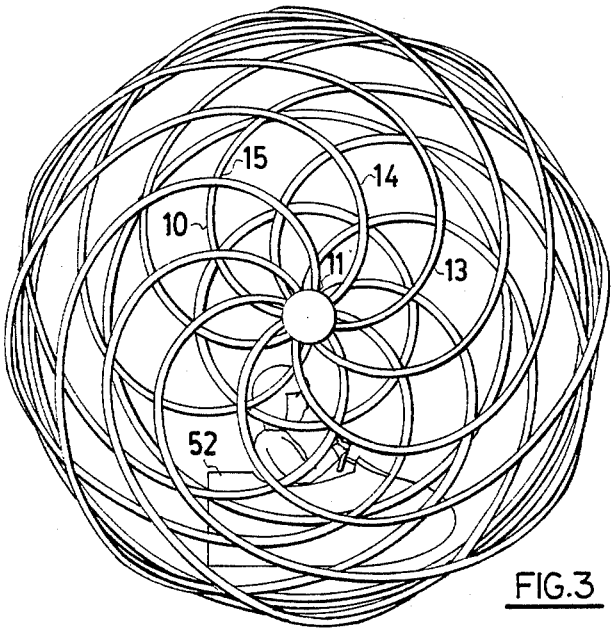
FIG. 3 is an end view of the frame and showing schematically a source of power therein.
Figure 4:
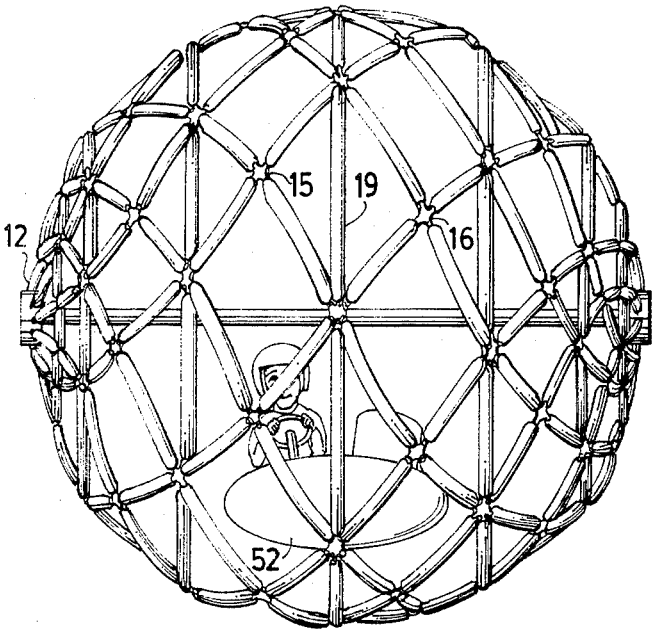
FIG. 4 is a view at right angles to FIG. 3.

Proceeding therefore to describe the invention in detail, reference should first be made to FIGS. 3 and 4 which show the basic concept in the construction of the frame.

Figure 5:
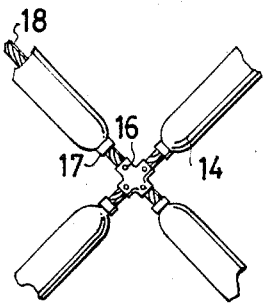
FIG. 5 is an enlarged fragmentary view showing one method of connecting intersecting members together.

The frame is formed as a hollow sphere from two sets of spiralling resilient frame members and reference to FIG. 3 will show that one set 10 spirals clockwise from one end 11 of an axis to the other end 12 thereof whereas the other set 13 spirals counterclockwise from one end 11 of the axis to the other end 12. Each set consists of a plurality of resilient members specifically designated 14 which may be formed from hollow plastic or other resilient material. In the illustrated embodiment, each set consists of eight such members spiralling from one axis to the other in contra-spiral relationship and intersecting at points indicated by reference character 15 at which point they may be secured as by rivets 16 or, when used in larger embodiments, by a method such as that illustrated in FIG. 5 in which the individual tubes 14 are secured by the ends thereof over the stubs 16 of a four-way valve intersection member and held thereon by means of hose clamps 17. In this embodiment, it is desired that the tubes or hoses 14 be inflated to give sufficient strength and, if desired, a tensioned cable 18 may extend through the individual lengths of tubes or hose.

When constructed as illustrated in the drawings, the intersecting members of the two sets form a hollow sphere having a geodesic configuration and, if desired, latitudinally extending reinforcing hoops 19 may extend in spaced and parallel relationship in a plane at right angles to the axis 11–12. These latitudinal reinforcing members are secured to corresponding intersections of the members of the individual sets as clearly shown in FIG. 4.

Figure 1:
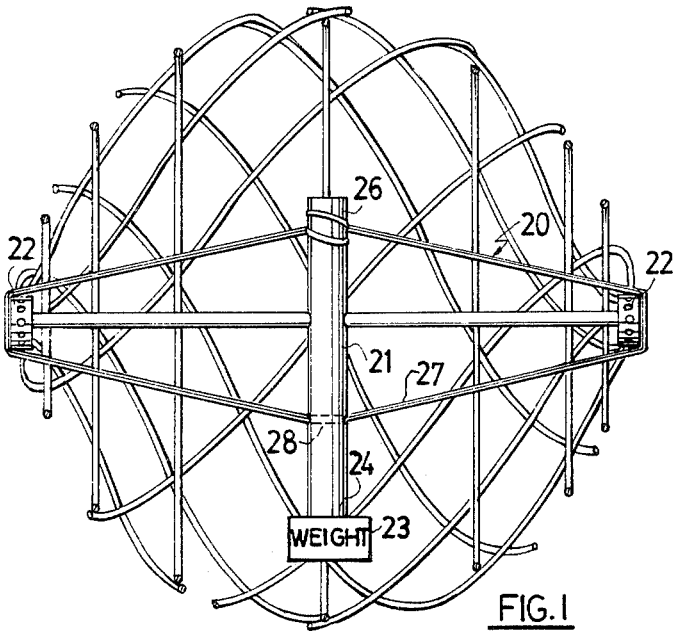
FIG. 1 is a front elevation of the device used as a toy and with an elastic motor therein.
Figure 2:
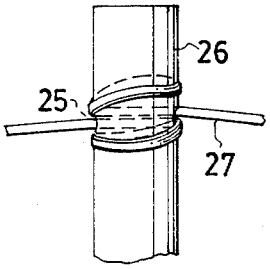
FIG. 2 is a fragmentary enlarged view of the upper end of the vertical member of FIG. 1 showing one method of attaching the ends of the elastic band thereto.

When used as a toy as illustrated in FIG. 1, an elastic motor may be provided collectively designated 20. A vertical shaft or member 21 is apertured substantially intermediate the ends thereof and threaded over an axle 21 extending along the axis 11–12 and terminating in hubs 22 to which the members 13 and 14 of the two sets may be secured. A reaction weight 23 is secured to the lower end 24 of the member 21 and an aperture 25 is formed through the upper end 26 as shown in FIG. 2.

An endless elastic band 27 has one end passed through the aperture 25 and is then looped over the upper end 26 to secure same to the member 21. It then extends to hub 22 to which it is secured and then through an aperture 28 in the member 21 adjacent the lower end thereof. From there it passes to the other hub 22 to which it is secured and then back to the aperture 25, passing therethrough so that the opposite end may then also be looped over the upper end 26 thus securing the band in position.

In operation, the sphere is rotated with the weight 23 maintaining the member 21 substantially vertical thus winding the elastic band around the shaft 21 and storing kinetic energy therein. When placed upon the ground, the elastic band unwinds from the shaft with the weight 23 maintaining the member 21 vertical and thus rotates the sphere across the supporting surface.

Figure 7:
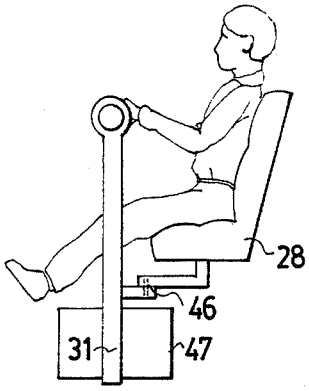
FIG. 7 is a side elevation of FIG. 6.
Figure 9:
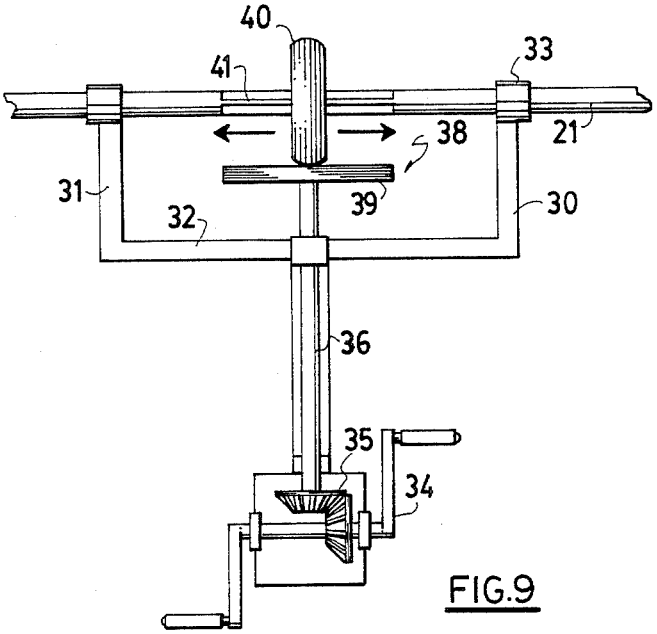
FIG. 9 is a fragmentary front elevation showing a drive connection from a pedal assembly to the axle.

FIG. 9 shows a source of power usable when the device is large enough to be used as a recreational device. Under these circumstances, an occupant may enter through one of the larger areas defined by the members forming the frame and may be seated in a seat 29 as shown in FIG. 7.

This seat is supported upon a U-shaped frame 30 consisting of vertical members 31 and cross member 32. The vertical members 31 are supported by bearings 33 upon shaft 21 and a pedal assembly 34 depends downwardly from frame 30. This pedal assembly is driven by a bevel gear assembly 35 thus operating a vertically situated drive shaft 36 which in turn is operatively connected to shaft 21 either by a corresponding bevel gear assembly 37 (see FIG. 6) or by an infinitely variable drive assembly collectively designated 38 and shown in FIG. 9. This consists of a friction disc 39 rotatable by shaft 36 in a horizontal plane engageable by a rubber tired drive wheel 40 which may be moved along a splined portion 41 of shaft 21 by any conventional means thus controlling the gear ratio between the pedal assembly 34 and the shaft 21, the weight of the pedal assembly and the operator in the passenger seat 29 acting as the reaction weight converting the power from the pedals 34 to the shaft 21.

Figure 8:
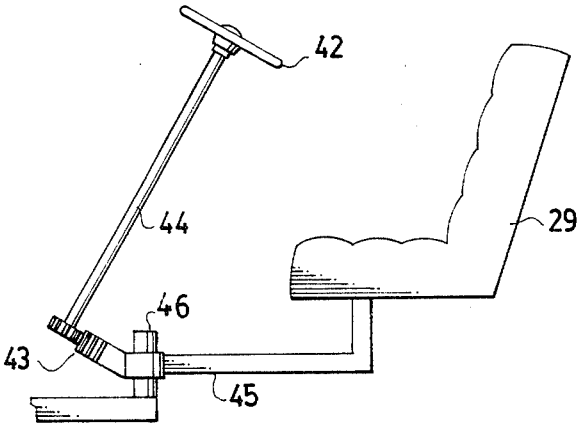
FIG. 8 is a fragmentary partially schematic view showing one method of steering the device.

Steering may be obtained by shifting the weight to one side or other other relative to the central vertical plane of the device and FIG. 8 shows schematically, one method of accomplishing this. A steering wheel 42 is suitably supported for rotation within frame 30 adjacent passenger seats 29. A rack and pinion gear assembly 43 is provided at the base of the steering wheel shaft 44 and on one end of a lever 45 pivoted intermediate the ends thereof upon a pivot pin 46. The passenger supporting seat 29 is secured upon the other end of lever 45 so that rotation of the steering wheel moves the seat and the passenger to one side or the other of the central vertical plane thus shifting the weight and allowing the sphere to be steered, at various degrees from the straight ahead line of travel, depending upon the displacement of the weight of the seat and passenger.

Figure 6:
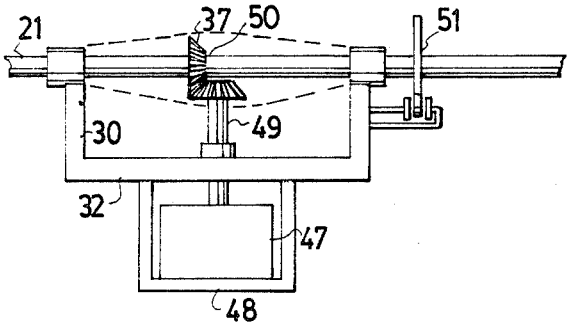
FIG. 6 is a fragmentary front elevation of the source of power connection to the axle together with a view of a disc brake assembly.

Finally, reference should be made to FIG. 6 together with FIGS. 3 and 4 which show the device adapted for use as a transportation vehicle. Once again a frame 30 is provided suspended from axle 21 and having a source of power such as a motor 47 mounted below the cross member 32 of the frame and within a motor support frame 48.

The drive shaft 49 is driven directly from the motor and a bevel gear assembly 50 operatively connects the drive shaft 49 to the axle 21. The gears of course should be shielded from the passenger seat 29 which is secured to the supporting frame in a manner similar to that shown in FIGS. 7 and 8.

Means are provided to act as a brake to the rotation of shaft 21 and may take the form of a disc brake assembly 51 shown schematically in FIG. 6 and operated in a conventional manner either by hand or by foot.

It will also be appreciated that the infinitely variable drive shown in FIG. 10 may also be used in the embodiment shown in FIG. 6 depending upon design parameters.

Although FIGS. 6 and 7 show schematically, a method of powering the device by means of motor 47, nevertheless it will of course be appreciated that all of the operating parts together with the seat assembly 29 may be enclosed within a body 52 similar to that shown in FIGS. 3 and 4.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A hollow sphere for use as a toy, a recreational device or as a transportation vehicle comprising in combination one set of resilient members extending from one end of an axis to the other and spiralling through 360°, another set of resilient members extending from said other end of said axis to said one end thereof and spiralling through 360° in the opposite direction of said one set, each set including a plurality of resilient members secured by one end thereof to a hub at said one end of said axis and by the other ends thereof to a hub at said other end of said axis, the members of said one set being secured to the members of the other set where said members intersect thus forming a geodesic configuration, an axle extending between said hubs, and an elastic motor operatively connected to said axle, said motor including a substantially vertical member, said member being tranversely apertured intermediate the ends thereof and being freely engaged over said axle, an action weight means at the lower end of said member and an elastic band anchored by one end thereof to the other end of said member, engaging one of said hubs, and extending to said member adjacent the lower end thereof, then extending to and engaging the other of said hubs and extending to and being secured to the upper end of said member.

2. The sphere according to claim 1 which includes a plurality of spaced and parallel circumferential members extending around the said sphere and being secured to adjacent intersections of said members of said sets.

3. The sphere according to claim 1 in which said axle is fixedly secured to said hubs.

4. The sphere according to claim 3 which includes a frame bearably supported upon said axle and depending therefrom, a source of power carried by said frame and means connecting said source of power to said axle for rotating same and hence rotating said sphere.

5. A hollow sphere for use as a toy, a recreational device or as a transportation vehicle comprising in combination one set of resilient members extending from one end of an axis to the other and spiralling through 360°, another set of resilient members extending from said other end of said axis to said one end thereof and spiralling through 360° in the opposite direction of said one set, each set including a plurality of resilient members secured by one end thereof to a hub at said one end of said axis and by the other ends thereof to a hub at said other end of said axis, the members of said one set being secured to the members of the other set where said members intersect thus forming a geodesic configuration, an axle extending between said hubs, a frame bearably supported upon said axle and depending therefrom, a source of power carried by said frame, including a foot pedal assembly depending below said frame means connecting said source of power to said axle for rotating same and hence rotating said sphere, and passenger supporting means attached to said frame operatively adjacent said foot pedal assembly.

6. The sphere according to claim 5 in which said axle is fixedly secured to said hubs.

7. The sphere according to claim 5 which includes a plurality of spaced and parallel circumferential members extending around said sphere and being secured to adjacent intersections of said members of said sets.

8. The sphere according to claim 5 in which said means operatively connecting said source of power to said axle includes a substantially vertical main shaft, a bevel gear assembly operatively connecting said pedal assembly to the lower end of said main shaft, and a bevel gear assembly operatively connecting the upper end of said main shaft to said axle.

9. The sphere according to claim 8 which includes means associated with said passenger supporting means to steer said sphere, said means including means to place said passenger support means and the passenger therein, to one side or the other of the central vertical plane of said sphere thereby biasing said sphere to one side or the other.

10. The sphere according to claim 9 in which said means associated with said passenger supporting means to steer said sphere includes steering means attached to said frame, a lever pivoted intermediate the ends thereof to said frames, rack and pinion means operatively connecting the lower end of said steering means to one end of said lever, said passenger support means being supported upon the other end of said lever whereby actuation of said steering means displaces said passenger supporting means to one side or the other of the central vertical plane of said sphere.

11. The sphere according to claim 9 which includes brake means operatively extending between said frame and said axle and actuated by the passenger carried by said passenger support means.

12. The sphere according to claim 5 in which said means operatively connecting said source of power to said axle includes a substantially vertical main shaft, a bevel gear assembly operatively connecting said pedal assembly to the lower end of said main shaft, and an infinitely variable drive assembly operatively connecting the upper end of said main shaft to said axle.

13. The sphere according to claim 12 which includes means associated with said passenger supporting means to steer said sphere, said means including means to place said passenger support means and the passenger therein, to one side or the other of the central vertical plane of said sphere thereby biasing said sphere to one side or the other.

14. The sphere according to claim 13 in which said means associated with said passenger supporting means to steer said sphere includes steering means attached to said frame, a lever pivoted intermediate the ends thereof to said frames, rack and pinion means operatively connecting the lower end of said steering means to one end of said lever, said passenger support means being supported upon the other end of said lever whereby actuation of said steering means displaces said passenger supporting means to one side or the other of the central vertical plane of said sphere.

15. The sphere according to claim 5 in which said source of power includes an engine, means mounting said engine in said frame and means operatively connecting said engine to said axle for rotating same and hence rotating said sphere.

16. The sphere according to claim 15 which includes passenger supporting means attached to said frame.

17. The sphere according to claim 16 which includes means associated with said passenger supporting means to steer said sphere, said means including means to place said passenger support means and the passenger therein, to one side or the other of the central vertical plane of said sphere thereby biasing said sphere to one side or the other.

18. The sphere according to claim 15 which includes infinitely variable drive assembly operatively connecting the upper end of said shaft to said axle.

19. The sphere according to claim 15 which includes means associated with said passenger supporting means to steer said sphere, said means including means to place said passenger support means and the passenger therein, to one side or the other of the central vertical plane of said sphere thereby biasing said sphere to one side or the other.

20. The sphere according to claim 19 in which said means associated with said passenger supporting means to steer said sphere includes steering means attached to said frame, a lever pivoted intermediate the ends thereof to said frames, rack and pinion means operatively connecting the lower end of said steering means to one end of said lever, said passenger support means being supported upon the other end of said lever whereby actuation of said steering means displaces said passenger supporting means to one side or the other of the central vertical plane of said sphere.

* * * * *